US005661261A

United States Patent [19]

Ramaswamy et al.

[11] Patent Number: 5,661,261

[45] Date of Patent: Aug. 26, 1997

[54] GAS GENERATING COMPOSITION

[75] Inventors: Coodly Puttasastry Ramaswamy, Plant City; Cezary Grzelczyk, Lakeland, both of Fla.

[73] Assignee: Breed Automotive Technology, Inc., Lakeland, Fla.

[21] Appl. No.: 606,319

[22] Filed: Feb. 23, 1996

[51] Int. Cl.[6] ..... C06B 29/08; C06B 31/08

[52] U.S. Cl. ..... 149/36; 149/37; 149/70; 149/83; 149/85; 149/86

[58] Field of Search ..... 149/36, 37, 61, 149/77, 70, 83, 85, 86

[56] References Cited

U.S. PATENT DOCUMENTS

| | | | |
|---|---|---|---|
| 1,511,771 | 10/1924 | Rathsburg | 149/108.6 |
| 3,055,911 | 9/1962 | Finnegan et al. | 548/250 |
| 3,171,249 | 3/1965 | Bell | 60/215 |
| 3,348,985 | 10/1967 | Stadler et al. | 149/2 |
| 3,468,730 | 9/1969 | Gawlick et al. | 149/61 |
| 3,719,604 | 3/1973 | Prior et al. | 252/186.33 |
| 3,734,789 | 5/1973 | Moy et al. | 149/19.4 |
| 3,739,574 | 6/1973 | Godfrey | 60/39.06 |
| 3,897,285 | 7/1975 | Hamilton et al. | 149/41 |
| 3,898,112 | 8/1975 | Strecker et al. | 149/19.9 |
| 3,909,322 | 9/1975 | Chang et al. | 149/19.4 |
| 3,912,561 | 10/1975 | Doin et al. | 149/35 |
| 3,954,528 | 5/1976 | Chang et al. | 149/19.4 |
| 4,369,079 | 1/1983 | Shaw | 149/2 |
| 4,370,181 | 1/1983 | Lundstrom et al. | 149/2 |
| 4,931,112 | 6/1990 | Wardle et al. | 149/88 |
| 4,948,439 | 8/1990 | Poole et al. | 149/46 |
| 5,035,757 | 7/1991 | Poole | 149/46 |
| 5,053,086 | 10/1991 | Henry et al. | 149/19.4 |
| 5,139,588 | 8/1992 | Poole | 149/61 |
| 5,197,758 | 3/1993 | Lund et al. | 280/741 |
| 5,198,046 | 3/1993 | Bucerius et al. | 149/61 |
| 5,344,186 | 9/1994 | Bergerson et al. | 280/741 |
| 5,345,876 | 9/1994 | Rose et al. | 102/531 |
| 5,386,775 | 2/1995 | Poole et al. | 102/209 |
| 5,424,449 | 6/1995 | Rothgery et al. | 548/251 |
| 5,439,251 | 8/1995 | Onishi et al. | 280/741 |
| 5,451,682 | 9/1995 | Highsmith et al. | 548/251 |
| 5,460,668 | 10/1995 | Lyon | 149/36 |
| 5,500,059 | 3/1996 | Lund et al. | 149/19.1 |
| 5,516,377 | 5/1996 | Highsmith et al. | 149/18 |

OTHER PUBLICATIONS

Kaye, Encyclopedia of Explosives and Related Items, PATR 2700, vol. 9, US Army Research and Development Command, Dover, NJ (1980), pp. T111–T140.

*Primary Examiner*—Edward A. Miller

*Attorney, Agent, or Firm*—Lonnie R. Drayer; Donald O. Nickey

[57] ABSTRACT

A solid composition for generating gases when ignited is a combination 5-aminotetrazole and at least two oxidizers selected from the group consisting of potassium nitrate, potassium per-chlorate, ferric oxide, copper oxide and manganese dioxide.

3 Claims, 2 Drawing Sheets

GAS GENERATING COMPOSITION

FIELD OF THE INVENTION

The present invention relates to a solid gas generating composition of 5-aminotetrazole combined with a plurality of oxidizers.

BACKGROUND OF INVENTION

The present invention relates to the development and use of a solid gas generating composition which, unlike the sodium azide based gas generating compositions which are currently widely use to inflate airbags in motor vehicles, uses a non-azide chemical compound as the fuel. The non-azide chemical compound reacts with a multi-oxidizer system to generate nonhazardous gases, primarily containing nitrogen. The gases so liberated have been primarily designed to fill airbags used in the automobile industry, but other uses can also be visualized for such gas generating compositions.

The present invention is primarily directed towards the automotive airbag industry, which has historically had to deal with toxicity issues. The airbag systems currently produced most often use gas generating compositions based on sodium azide as a fuel in combination with metallic oxidizers. The use of sodium azide has a number of advantages. It is a solid, easily produced in a high degree of purity, and can be used to prepare gas generating compositions in combination with one or more metallic oxidizers, to yield solid gas generating compositions at very reasonable costs. However the greatest disadvantage of sodium azide is its high toxicity. The ingestion of even small amounts of sodium azide in a human could cause a rapid decrease in blood pressure and even death. This toxicity problem is potentially accentuated as the cars with sodium azide in the airbag system get scrapped. If the gas generating devices of airbag systems containing sodium azide are not removed from vehicles before scrapping, they could cause an environmental hazard.

To overcome this problem, various approaches have been taken by the airbag industry, one such approach being the use of stored gases to fill the airbags. The gases are stored at high pressure in a cylinder with a rupture disc. The rupture of these discs is triggered by a crash pulse, picked up by an electro-mechanical or electronic sensor. The gases used are inert gases like helium and argon. A variation of the same employs a pyrotechnic gas generating composition, the heat of which is used to raise the temperature of the gas in a stored gas system and is commonly referred to as a hybrid system. There are number of patents covering stored gas and hybrid systems. Examples of these types of systems are taught for example in U.S. Pat. No. 5,344,186 and U.S. Pat. No. 5,345,876. While the stored gas and hybrid systems give a clean inflation gas, with very little or no particulate, they are cumbersome and difficult to make function at the high and low temperature extremes required by the industry. Also the stored gases could leak during a long storage period.

The present invention overcomes most of these problems with a gas generating composition which is a solid, easily manufactured and has good storage properties. Furthermore, most of the equipment used in the manufacture of sodium azide based gas generating compositions can be used in the manufacturing of these non-azide generating compositions.

DISCUSSION OF THE PRIOR ART

Interest in developing gas generating compositions, not based on sodium azide, has attracted the efforts of research workers in the airbag industry and has resulted in a number of patents.

U.S. Pat. No. 3,468,730 discloses the use of organic fuels like 5-aminotetrazole, guanyl amino 0.5 tetrozole and 1-guanyl 3-tetrazolyl 0.5 guandine in combination with oxidizers such as barium nitrate, potassium dichromate, potassium nitrate, lead dioxide, manganese dioxide, and copper oxide. They have been activated by compositions using the same fuel and oxidiser in different proportions. This patent relates to a propellant charge for switching elements and/or for control of processes and does not relate to the field of airbags for automotive industry.

U.S. Pat. No. 3,909,322 teaches non-azide gas generating compositions based on the use of fuels like guanidinium 0.5 nitamino tetrazole, ammonium 5-aminotetrazole and hydrazinium 5-nitramino tetrazole in combination with both organic and inorganic oxidants and compatible binders. The objective of this patent is to teach an improved gun propellant.

U.S. Pat. No. 3,898,112 teaches a solid gas generating composition based on 5-aminotetrazole nitrate as the oxidant and using block copolymers based on styrene—butadiene—styrene and styrene isoprene systems. The utility of these compositions is not mentioned, but presumably relates to ordnance applications. Gases from the composition like the above should result in highly toxic gases like CO, NOx, and $NH_3$.

U.S. Pat. No. 3,954,528 proposes a gas generating gun propellant using triamino gueanidane nitrate along with an oxidiser and a suitable compatible binder material. A composition given as an example uses TAGN, ammonium nitrate and polymer binder with other additives.

U.S. Pat. No. 4,369,079 teaches a solid non-azide, non-toxic gas generating composition for use in airbags. The fuel used is sodium and potassium salts of BIS Azo tetrazole or Bis tetrazole along with inorganic oxidisers like sodium nitrite, sodium nitrate and potassium nitrate. The gases produced have carbon monoxide at acceptable levels.

U.S. Pat. No. 4,370,181 discloses a non-azide, non-toxic, nitrogen gas generating composition for use in deployment of automobile airbags. It uses alkaly and alkaline earth metal salts of Bis tetrazole and uses oxidizers like sulfur, chromium trichloride, molybdenium disulphide, and iron trifluoride. One example of the exhaust gases and pressure in a tank test is given where the composition is $Na_2$ Bis tetrazole and sulfur, but there is no mention of the size of the tank used in the test. Use of fluorine and chromium compounds would be unacceptable to the airbag industry. Also use of sulfur could give unacceptable levels of oxides of sulfur and $H_2So_4$.

U.S. Pat. No. 5,197,758 teaches a gas generating composition for automobile airbags. It uses zinc and copper complexes of 5-aminotetrazole and 3 amino 1,2,4 triazole with inorganic oxidizers like potassium nitrate and strontium nitrate.

SUMMARY OF INVENTION

The present invention provides a gas generating composition capable of delivering predominantly nitrogen gas and some lesser quantities of other non toxic gases like carbon dioxide, using a non azide fuel and a combination of inorganic oxidizers. Other advantages of the system would become apparent to those skilled in the art, as given in the detailed description in of the invention and the claims which follow.

There is provided in accordance with one aspect of the invention a solid composition for generating gases when ignited comprising in combination 5-aminotetrazole and at least two oxidizers selected from the group consisting of potassium nitrate, potassium per-chlorate, ferric oxide, copper oxide and manganese dioxide.

BRIEF DESCRIPTION OF THE DRAWINGS

The features of the invention which are believed to be novel are set forth with particularity in the appended claims. The present invention, both as to its structure and manner of operation, may best be understood by referring to the following detailed description, taken in accordance with the accompanying drawings in which:

DETAILED DESCRIPTION OF THE INVENTION

Figure 1:
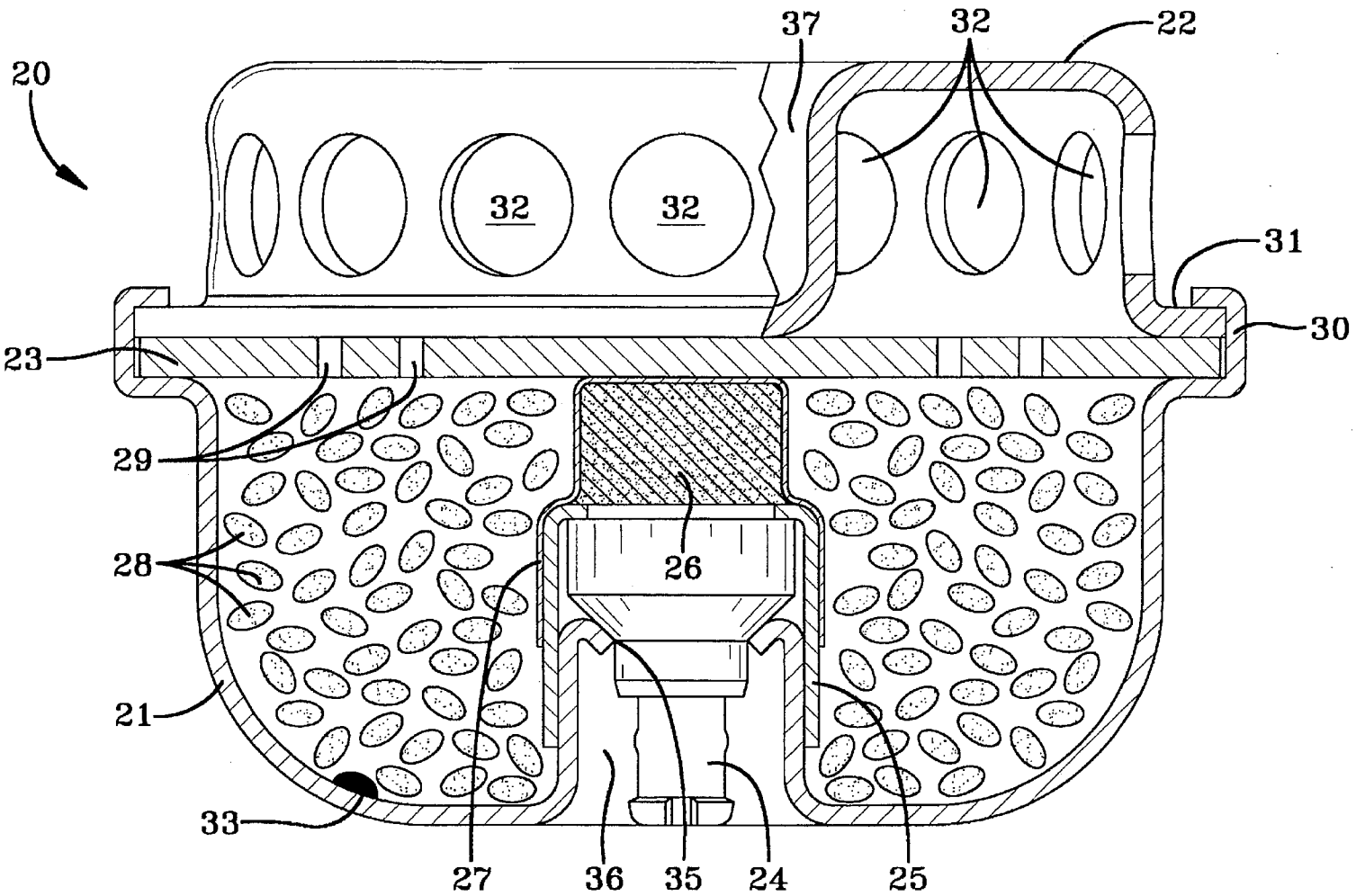
FIG. 1 is a side view, partially in section, of a gas generating device which may used with the gas generating composition of the present invention.

The fuel used in the gas generating composition of the present invention is 5-aminotetrazole which was initially manufactured by reacting amino guanidine with nitrous acid, but more elegant methods of manufacturing have been developed since then. It normally crystallizes with one molecule of water and has the structure shown below:

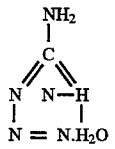

5-aminotetrazole, hereinafter referred to as "5-AT" has a nitrogen content of 67.9%, and a melting point of 202° C. It is capable of forming salts with alkalay and alkaline earth metals. It is advantageous as a fuel for a non-azide gas generating composition, not only because of its high nitrogen content, but also the presence of only one carbon atom in the molecule which has to be taken to its highest oxidation state for giving a non toxic gas. The 5-AT is combined with at least two inorganic oxidizers selected from a the group consisting of potassium nitrate ($KNO_3$), potassium perchlorate ($KClO_4$), manganese dioxide ($MnO_2$), iron oxide ($Fe_2O_3$), and copper oxide (CuO). While an anhydrous variety of 5-aminotetrazole is preferred, a hydrated variety is also acceptable. An anhydrous variety of this compound is available which enhances its value for developing a non-azide gas generating composition, as the nitrogen content goes up to 82.3%, which makes it extremely attractive for the aforementioned objectives. The oxidizers combined with the 5-AT are all commonly available chemicals in a high degree of purity and with no water of crystallization in their molecules.

In accordance with the present invention the fuel and oxidizers are mixed in predetermined stoichio metric ratios. Standard mixing equipment for mixing energetic solids of the types well known to those who have the skill and knowledge of this art is used in the manufacture of the gas generating composition.

For the gas generating reaction to occur in the designed time frame, as required for the effective deployment of airbags in vehicles, it is necessary to comminute these materials to desired particle size. The partical sizes are determined using state of art equipment for measuring particle size distribution. The 50% point would be a good guidance for controlling the particle size. In the examples presented below, and the preferred method of manufacturing the gas generating compositions of the present invention, the particles sizes of the various components prior to combining them were as follows: 5-AT 12–32 microns; $KNO_3$ 20–30 microns; $KClO_4$ 20–30 microns; $MnO_2$ 2–5 microns; $Fe_2O_3$ 0.5–1.5 microns; and CuO 5–10 microns. As used herein and in the claims a micron is understood to be $10^{-4}$ centimeters.

In the examples presented below, and the preferred method of manufacturing the gas generating compositions of the present invention, the composition is formed into units, such as tablets, having a density in the range of about 2.5–2.7 gm/cc. For instance in the following examples the gas generating compounds were formed into tablets weighing 60–70 mg with a diameter of about 5 mm and a thickness of about 2 mm. In the examples presented below, and the preferred method of manufacturing the gas generating compositions of the present invention, the tablets had a moisture content (water) of about 0.5–1.5%, by weight which is believed to be important if the gas generating composition is to be used for inflating a vehicle safety system airbag. In the examples presented below, and the preferred method of manufacturing the gas generating compositions of the present invention, the tablets contain as free flow agents, by weight, about 0.5% magnesium silicate and about 0.5% aluminum oxide, both of which are available from D'Gussa in Germany. It is believed that any suitable standard tableting equipment may be employed in practicing the invention.

The compositions are evaluated in a 60 Liter (L) test tank with arrangements to record the pressure-time profile and arrangements to sample the gas for determining the toxic components of the gas generated.

When a gas generating composition comprising in combination 5-aminotetrazole and at least two oxidizers selected from the group consisting of potassium nitrate, potassium per-chlorate, ferric oxide, copper oxide and manganese dioxide was ignited in a conventional airbag inflator housing the gas which was generated did not meet the standards of the airbag industry for inflation gases. It was observed while a primary gas generating reaction occurred inside the inflator housing, a secondary reaction involving the generated gases was occurring within the tank which contained the gases. Surprisingly, by using a housing which allows substantially the complete gas generating reaction to take place in the confinement of the housing the gases generated do meet the standards of the airbag industry for inflation gases.

Figure 2:
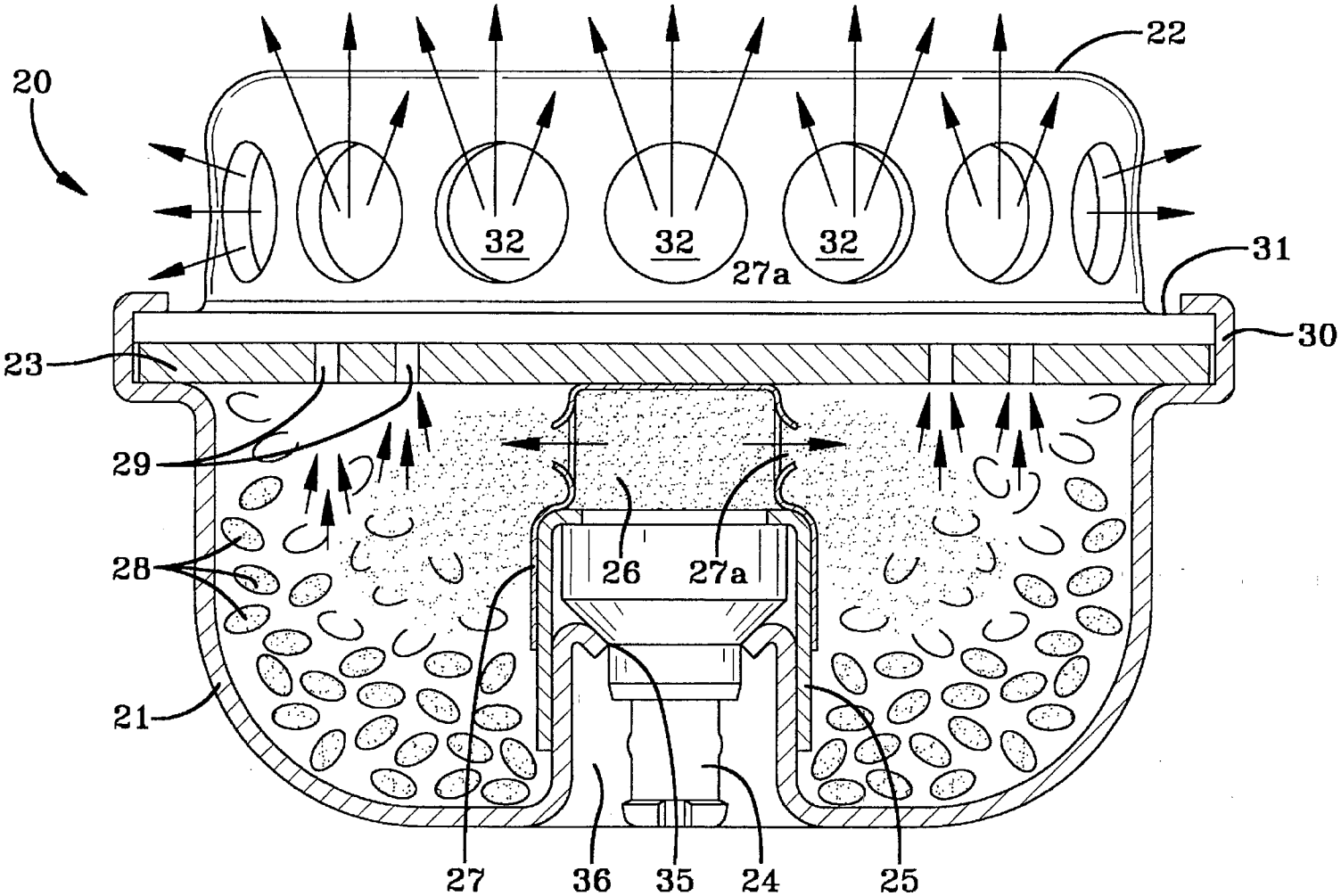
FIG. 2 is a side view, partially in section, of the gas generating device of FIG. 1 illustrating the operation of the device during the gas generation process.

Referring to FIGS. 1 and 2 there is shown an exemplary gas generating device 20 which may be used with the gas generating composition of the present invention. A crash sensor (not shown) closes an electrical circuit or initiates a firing signal which activates a squib 24 which ignites a booster composition 26, which in turn ignites the gas generating composition 28 located in a housing. As used herein a squib is understood to be an electrical device having two electrodes insulated from one another and connected by a bridge wire. The bridge wire is preferably embedded in one or more layers of pyrotechnic compositions designed to give a flash (heat) of sufficient intensity to ignite the booster composition.

The exemplary gas generating device 20 comprises a first housing member 21, a second housing member 22, and a choke plate 23 which is interposed between the first and second housing members. The first housing member 21 has a flange 30 which is bent over to secure the choke plate and the second housing member to the first housing member. The housing members and choke plate may be formed of any suitable material, preferably aluminum or steel.

The first housing member 21 is cup shaped with a recess 36 extending inwardly from the closed end thereof. As used herein terms such as "inward", "inwardly" and so forth are understood to refer to directions going towards the interior of the gas generating device, and terms such as "outward" and "outwardly" are understood to refer to directions going towards the exterior of the gas generating device. The recess 36 in the closed end of the first housing member 21 has an aperture 35 therethrough to accommodate the assembly of a squib 24 with the first housing member. The squib is secured in place by a collar 25 which is telescoped over the inside surface of the closed end of the first housing member. A cup 27 containing a booster composition 26 is telescoped over the outside surface of the collar 25. The gas generating composition 28 is located in the first housing member. Preferably an auto-ignition substance 33 is disposed within the housing in close proximity to the gas generating composition 28. The auto-ignition substance is a composition which will spontaneously ignite at a preselected temperature, and thereby ignite the gas generating composition. The gas generating compositions of the present invention may react in a much more violent manner if the ambient temperature is elevated, for example above 180 degrees Fahrenheit, and so it is desirable to set off the reaction before such a violent reaction can occur.

A choke plate 23 having a plurality of apertures 29 therethrough is located at the open end of the first housing member. The significance of the number and size of the apertures through the choke plate is elaborated upon in detail below. A second housing member 22 is located at the open end of the first housing member 21 with the choke plate 23 located between the first and second housing members. The second housing member has a plurality of apertures 32 therethrough. The significance of the number and size of the apertures through the second housing member is elaborated upon in detail below. The second housing member is cup shaped. A flange 31 is located at the open end of the second housing member. In this exemplary device the choke plate 23 and the flange 31 of the second housing member are secured to the first housing member by a flange 30 of the first housing member which is bent over inwardly.

The following examples further illustrate gas generating compositions of the present invention which have utility in the airbag industry. They are illustrative of the invention, but are not limiting. Examples 1 through 7 have the gas generating compound ignited in a gas generating device having only a single chamber which contained metal chips to cool the generated gas, rather than two chambers, as in the exemplary gas generating device shown in FIGS. 1 and 2.

EXAMPLE 1

A solid composition for generating gases comprising, by weight, 38.1% 5-AT, 42.7% $KNO_3$ and 18.2% $MnO_2$. The amount of gas generating compound in the device was 45 gms. The theoretical number of moles of gas produced is 2.26 moles for 100 gms of the composition. In this experiment the amount of CO was 5,102 ppm, the amount of $NH_3$ was 7.5%, and the amount of $CO_2$ was 3.75%.

EXAMPLE 2

A solid composition for generating gases comprising, by weight, 34.1% 5-AT, 42.7% $KNO_3$ and 22.2% $MnO_2$. The amount of gas generating compound in the device was 40 gms. The theoretical number of moles of gas produced was 2.1 moles for 100 gms of the composition. In this experiment the amount of CO was not determined, the amount of $NH_3$ was 12.5%, and the amount of $CO_2$ was 6.25%.

EXAMPLE 3

A solid composition for generating gases comprising, by weight, 40% 5-AT, 38% $KNO_3$ and 22% CuO. The amount of gas generating compound in the device was 40 gms. The theoretical number of moles of gas produced was 2.35 moles for 100 gms of the composition. In this experiment the amount of CO was 195 ppm, the amount of $NH_3$ was 3.0%, and the amount of $CO_2$ was <0.1%.

EXAMPLE 4

A solid composition for generating gases comprising, by weight, 40% 5-AT, 30% of $KNO_3$ and 30% CuO. The amount of gas generating compound in the device was 40 gms. The theoretical number of moles of gas produced was 2.35 moles for 100 gms of the composition. In this experiment the amount of CO was 628 ppm, the amount of $NH_3$ was 1.25%, and the amount of $CO_2$ was 1.25%.

EXAMPLE 5

A solid composition for generating gases comprising, by weight, 38% 5-AT, 22% $KNO_3$, 12% $KClO_4$, 18% $MnO_2$ and 10% CuO. The amount of gas generating compound in the device was 43 gms. The theoretical number of moles of gas produced was 2.25 moles for 100 gms of the composition. In this experiment the amount of CO was 17,476 ppm, the amount of $NH_3$ was >1,250 ppm, and the amount of $CO_2$ was 1.25%.

EXAMPLE 6

A solid composition for generating gases comprising, by weight, 38% 5-AT, 24% $KNO_3$, 16% $KClO_4$, and 12% CuO. The amount of gas generating compound in the device was 43 gms. The theoretical number of moles of gas produced was 2.28 moles for 100 gms of the composition. In this experiment the amount of CO was 22,819 ppm, the amount of $NH_3$ was 829 ppm, and the amount of $CO_2$ was 2.0%.

EXAMPLE 7

A solid composition for generating gases comprising, by weight, 38% 5-AT, 26% $KNO_3$, 12% $KClO_4$, 12% $MnO_2$, and 12% CuO. The amount of gas generating compound in the device was 43 gms. The theoretical number of moles of gas produced was 2.31 moles for 100 gms of the composition. In this experiment the amount of CO was 5,263 ppm, the amount of $NH_3$ was 14 ppm, and the amount of $CO_2$ was 3.57%.

In examples 8–11 the gas generating composition was ignited in a dual chamber gas generating device, as in the exemplary gas generating devices of FIGS. 1 and 2.

EXAMPLE 8

The same gas generating composition used in example 7 was retested in a dual chamber gas generating device. The amount of gas generating composition in the device was 23 gms. The theoretical number of moles of gas produced was 2.31 moles for 100 gms of the composition. In this experiment the amount of CO was 63 ppm, the amount of $NH_3$ was <0.5 ppm, and the amount of $CO_2$ was 2.9%. This example clearly illustrates that when the disclosed gas generating compositions are ignited in a properly designed gas generating device the amount of CO in the generated gas can be controlled to be less than 200 ppm, and preferably less than 100 ppm. Furthermore, a smaller amount of the gas generating composition is required in order to yield the required volume of gas.

EXAMPLE 9

A solid composition for generating gases was made comprising, by weight, 38% 5-AT, 30% $KNO_3$, and 32% $Fe_2O_3$. The amount of gas generating compound in the device was 23 gms. The theoretical number of moles of gas produced was 2.28 moles for 100 gms of the composition. In this experiment the amount of CO was 3,868 ppm, the amount of $NH_3$ was 1,000 ppm, and the amount of $CO_2$ was 1.2%.

EXAMPLE 10

A solid composition for generating gases comprising, by weight, 38% 5-AT, 26% $KNO_3$, 12% $KClO_4$, 12% $Fe_2O_3$ and 12% $MnO_2$. The amount of gas generating compound in the device was 23 gms. The theoretical number of moles of gas produced was 2.5 moles for 100 gms of the composition. In this experiment the amount of CO was 167 ppm, the amount of $NH_3$ was 0.6%, and the amount of $CO_2$ was 3.3%.

EXAMPLE 11

A solid composition for generating gases comprising, by weight, 38% 5-AT, 26% $KNO_3$, 12% $Fe_2O_3$, 12% $KClO_4$, and 12% CuO. The amount of gas generating compound in the device was 23 gms. The theoretical number of moles of gas produced was 2.77 moles for 100 gms of the composition. In this experiment the amount of CO was 100 ppm, the amount of $NH_3$ was 1.1%, and the amount of $CO_2$ was 3.3%.

The foregoing examples indicate the wide range of requirements to which the gas generating compositions of the present invention could be tailored for different end uses. While certain preferred embodiments are described above, variations of these could be made by those skilled in the art and these examples do not limit the scope of the invention disclosed and claimed herein.

I claim:

1. A solid composition for generating gases when ignited comprising in combination, by weight, about 38% 5-aminotetrazole, about 26% potassium nitrate, about 12% potassium per-chlorate, about 12% manganese dioxide, and about 12% copper oxide.

2. A solid composition for generating gases when ignited comprising in combination, by weight, about 38% 5-aminotetrazole, about 26% potassium nitrate, about 12% potassium per-chlorate, about 12% ferric oxide and about 12% manganese dioxide.

3. A solid composition for generating gases when ignited comprising in combination, by weight, about 38% 5-aminotetrazole, about 26% potassium nitrate, about 12% ferric oxide, about 12% potassium perchlorate, and about 12% copper oxide.

* * * * *